US005836792A

United States Patent [19]

Thumma et al.

[11] Patent Number: 5,836,792

[45] Date of Patent: Nov. 17, 1998

[54] BOARD MOUNTABLE ELECTRICAL CONNECTOR

[75] Inventors: Mark Richard Thumma, Oberlin; Daniel Gerard Grab, Harrisburg; Charles Dudley Cooper, Harrisburg; Matthew Moo Uoong Cho, Harrisburg; Ricky Edward Brown, Lykens, all of Pa.

[73] Assignee: The Whitaker Corporation, Wilmington, Del.

[21] Appl. No.: 756,859

[22] Filed: Nov. 26, 1996

[51] Int. Cl.[6] ..... H01R 13/405

[52] U.S. Cl. ..... 439/736

[58] Field of Search ..... 439/733.1, 869, 439/637, 745, 736

[56] References Cited

U.S. PATENT DOCUMENTS

| | | | |
|---|---|---|---|
| 4,513,499 | 4/1985 | Roldan | 439/733.1 |
| 4,553,322 | 11/1985 | Cappos et al. | 29/739 |
| 4,904,212 | 2/1990 | Durbin et al. | 439/751 |
| 5,409,404 | 4/1995 | Reed | 439/736 |
| 5,462,456 | 10/1995 | Howell | 439/733.1 |

OTHER PUBLICATIONS

AMP One–Piece Printed Circuit Board Connectors Catalog 82619—Streamlined 1–92 (Published 1992) pp. 2, 16, 17, 25.

*Primary Examiner*—Neil Abrams
*Assistant Examiner*—Eugene G. Byrd
*Attorney, Agent, or Firm*—Katherine A. Nelson

[57] ABSTRACT

A connector (10) including a housing (12) and a plurality of terminals (40) extending in respective passageways (30) through the housing (12) from a mating face (14) to a board-mounting face (16) , the terminals (40) having board-mounting sections (60) extending beyond the board-mounting face (16) . Each passageway (30) has a preselected dimension from an outer housing wall (20) to an inner housing wall (26) . Each terminal (40) has a thickness dimension less than the passageway dimension. The board-mounting section (60) and at least a portion of the body section (50) of the terminal (40) adjacent thereto is embossed laterally from the plane of the body section a selected distance. Upon staking the terminals (40) in the respective passageways (30) , the embossed portion (52) of each terminal (40) is disposed adjacent the outer housing wall (20) and the remaining portion of the body section (50) is disposed adjacent an inner housing wall (26) . Thus terminals (40) formed of thin stock are usable with the housing and stakable thereto, while the board-mounting sections thereof remain accurately positioned with terminal-receiving holes (72) of a circuit board (70) .

3 Claims, 5 Drawing Sheets

BOARD MOUNTABLE ELECTRICAL CONNECTOR

FIELD OF THE INVENTION

This invention is directed to electrical connectors and more particularly to board mountable electrical connectors.

BACKGROUND OF THE INVENTION

In manufacturing electrical connectors that are to be mounted to circuit boards, it is essential that the board-mounting sections of the electrical terminals at the board mounting face of the housing be accurately positioned with respect to the corresponding array of terminal-receiving holes of a circuit board. For cost effective manufacturing of the connectors, it is desirable that the board-mounting sections have compliant portions rather than solder leads, thus eliminating the need for soldering the connector to the board. Furthermore, for cost effective manufacturing, it is desirable that the electrical connector be mountable to the circuit board by applying pressure from a flat tool to the top of the housing in what is known as a "flat rock" assembly technique. The design of the compliant section will vary with the thickness of the stock used for the terminals, the number of terminals in the electrical connector and the desired insertion force, as known in the art.

The thickness of the stock used for the terminals in the connector is determined by the amount of spring force and other characteristics desired for the terminal at the mating face of the connector and the current carrying capability required by the end user. Thus, the same style of connector can be manufactured with terminals having a variety of stock thicknesses. Typically, connectors have been made with housings that are designed to receive a specific thickness of terminals wherein the housing has terminal retention portions within the passageway to assure that the terminal is held in the proper location for mounting to a circuit board. Alternatively, the housing can be formed with an essentially straight passageway wherein the terminal is staked. To stake terminals into the housing, force is applied to a tool on the outside edge of the housing, which forces some of the housing material against configured areas of the terminal thereby forcing the housing material around the configured areas and the terminal body section against an adjacent inner housing wall. The staking method, while suitable with stock thicknesses that are approximately the width of the passageway, may not provide sufficient retention to hold the terminal in the passageway to resist the force generated during the flat rock insertion process. With thin stock terminals, there is the additional problem of the board-mounting section collapsing or buckling rather than moving into the hole of the board. Additionally, the thin board mounting sections may not have the same center-line spacing that was achieved with terminals made from thicker stock.

To reduce inventory and for cost effective manufacturing, it is desirable to be able to use the same housing for terminals having different stock thicknesses while retaining the capability to flat rock the connector to the board, maintain a desired centerline spacing for the connector regardless of the thickness of the terminals used in the connector housing, and provide sufficient column strength to the terminal to enable the use of compliant board-mounting sections to eliminate the soldering process.

SUMMARY OF THE INVENTION

The present invention is directed to a connector that alleviates the problems of the prior art. The connector has an insulating housing with a plurality of terminal-receiving passageways extending therethrough from a mating face to a board mounting face and a plurality of terminals disposed in respective passageways. Each passageway has a preselected dimension from an outer to an inner housing wall and are in position to be aligned with terminal-receiving holes of a circuit board. The terminals include boardmounting sections extending beyond the board-mounting face and terminal body sections disposed in and secured in the housing by staking. In accordance with the present invention, the terminals have a thickness dimension that is associated with and less than the preselected passageway dimension. Each terminal including the board-mounting section and at least a portion of the body section thereof adjacent thereto is embossed laterally from the plane of the body section a selected distance such that the board-mounting section will be properly positioned in the passageway and aligned with a board hole. After staking, the embossed area is disposed adjacent the outer housing wall while a remaining portion of the body section is disposed adjacent the inner housing wall. Terminals formed of thin stock, therefore, can be used in the housing and are stakable thereto, while the board-mounting sections remain accurately positioned with the terminal receiving holes. The embossed area furthermore strengthens the terminal column to permit the compliant board-mounting sections to be inserted into the terminal-receiving holes.

It is an object of the present invention to provide a connector that will accept terminals made in different stock thicknesses while maintaining accuracy of the board mounting sections with respect to the terminal-receiving holes of a circuit board.

It is a further object of the invention to provide a terminal having a thickness dimension less than the width of an associated housing passageway that can be secured in the passageway such that accurate positioning is maintained while enabling the assembly to be inserted by a flat rock technique.

It is another object of the invention to provide terminals that can be formed of thin stock for desired characteristics at the mating face yet have sufficient rigidity at the compliant board-mounting section to be mounted to a board without collapsing.

It is yet another object of the invention to have a cost effective manufacturing and assembly process.

An embodiment of the invention will now be described with reference to the accompanying drawings.

DETAILED DESCRIPTION OF THE DRAWINGS

For purposes of illustrating the invention, the terminal will be described for use in a card edge connector. It is to be understood that the terminal design may be used with other connectors that are to be mounted to circuit boards.

Figure 1:
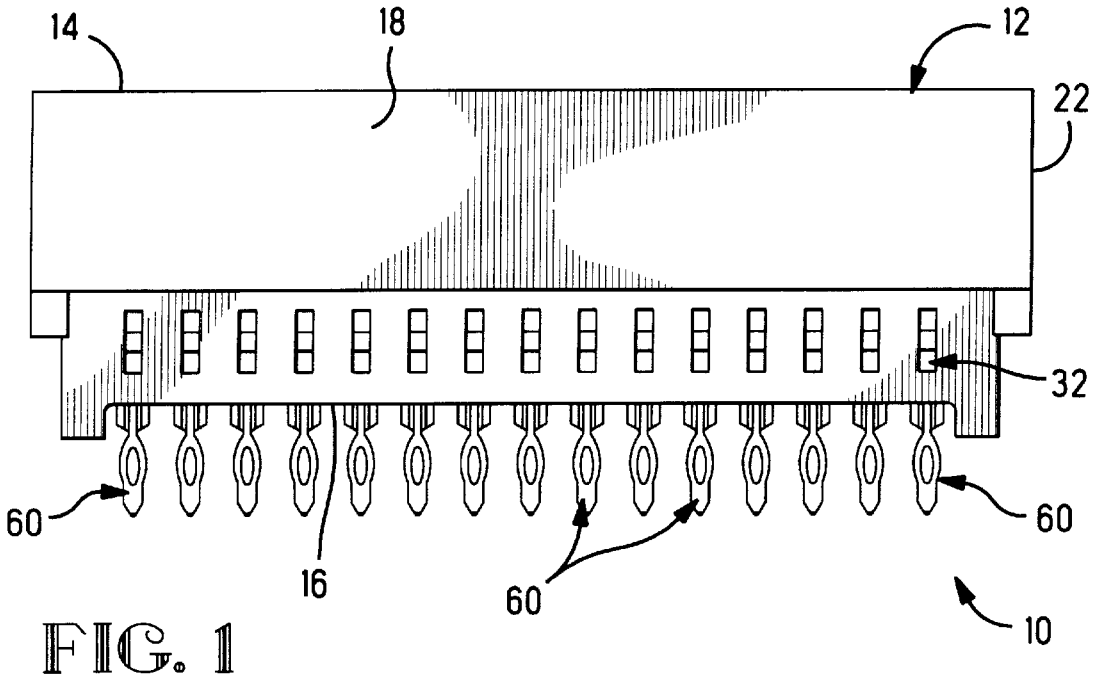
FIG. 1 is a side view of a connector made in accordance with the invention
Figure 2:
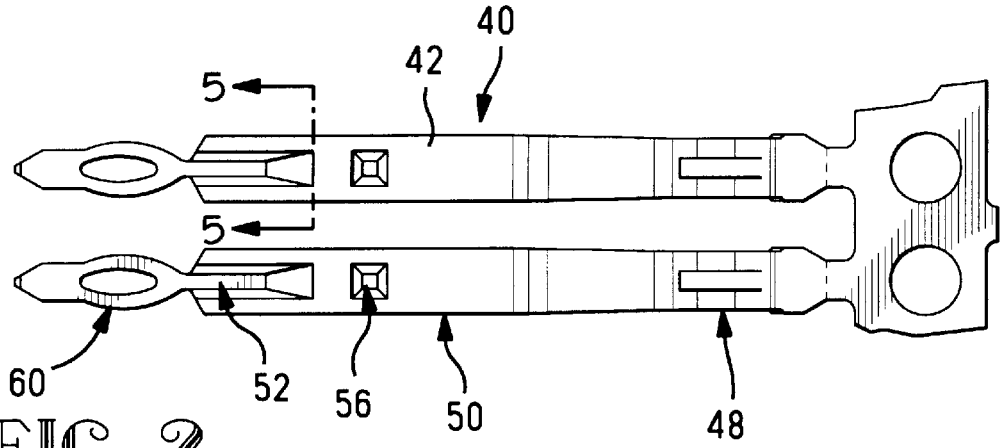
FIG. 2 is a plan view of a strip of terminals made in accordance with the invention.
Figure 5:
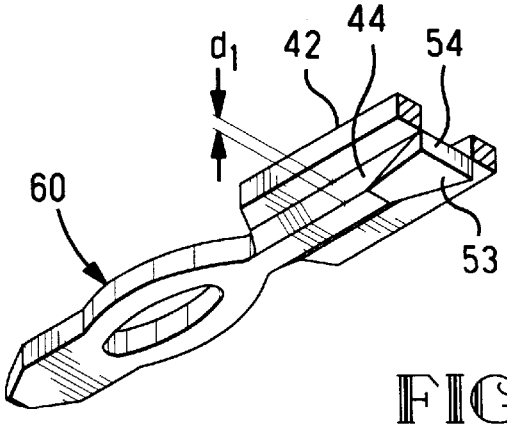
FIG. 5 is an isometric view taken along the line 5–5 of FIG. 2.
Figure 3:
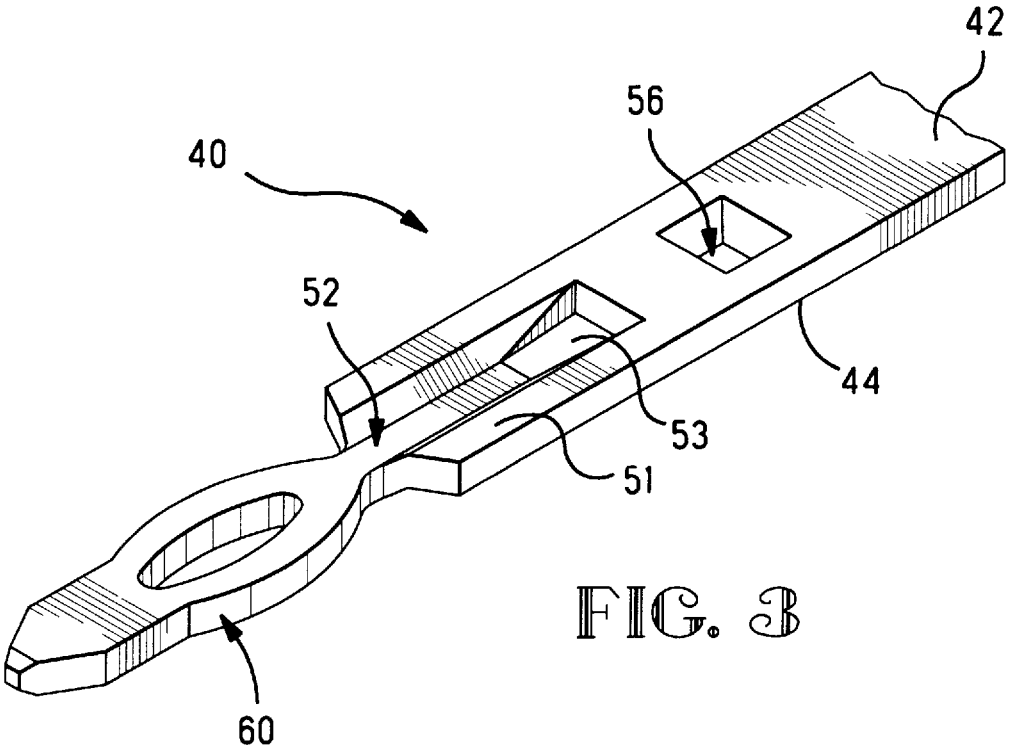
FIG. 3 is an isometric view of a fragmentary portion of the terminal of FIG. 2 illustrating one side of a terminal body and board mounting section.
Figure 4:
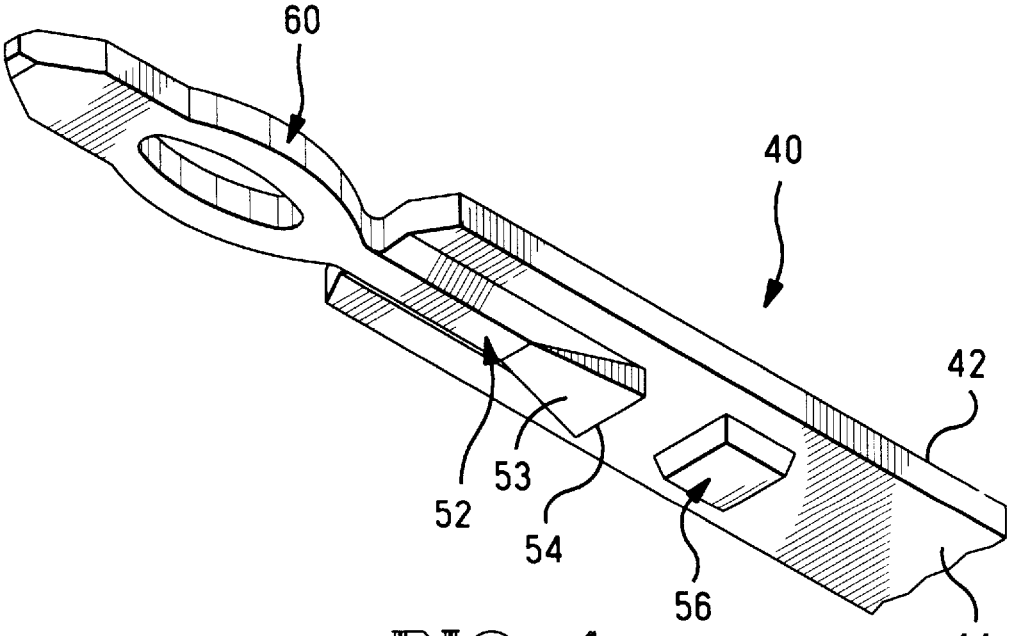
FIG. 4 is a view similar to FIG. 3 showing the other side of the terminal.
Figure 6:
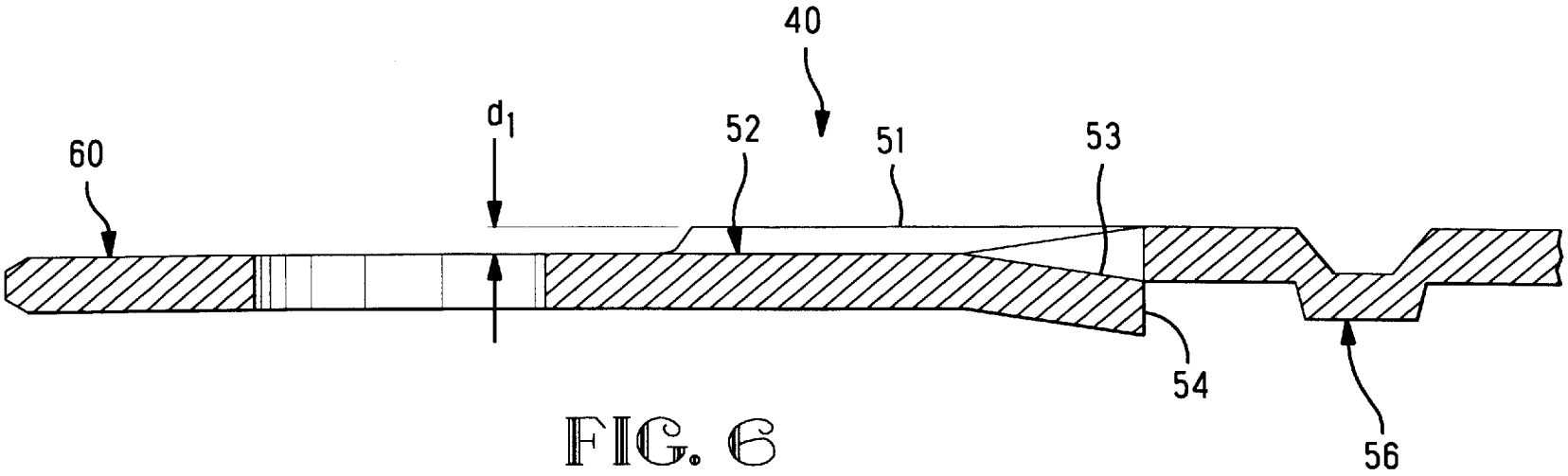
FIG. 6 is a longitudinal sectional view of the terminal made in accordance with the invention.
Figure 7:
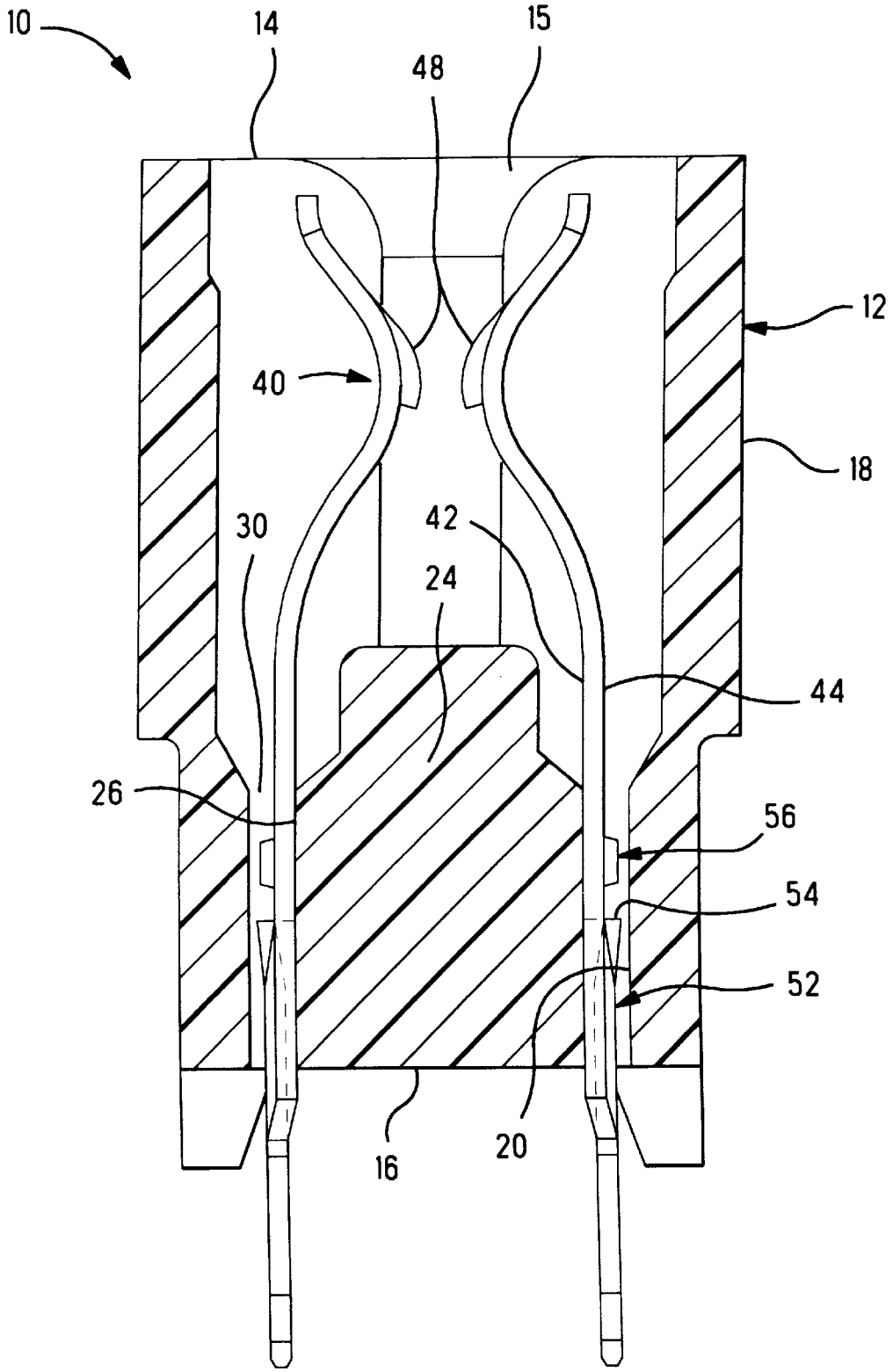
FIG. 7 is a cross-sectional view of the housing having a terminal therein prior to staking of the terminals.
Figure 8:
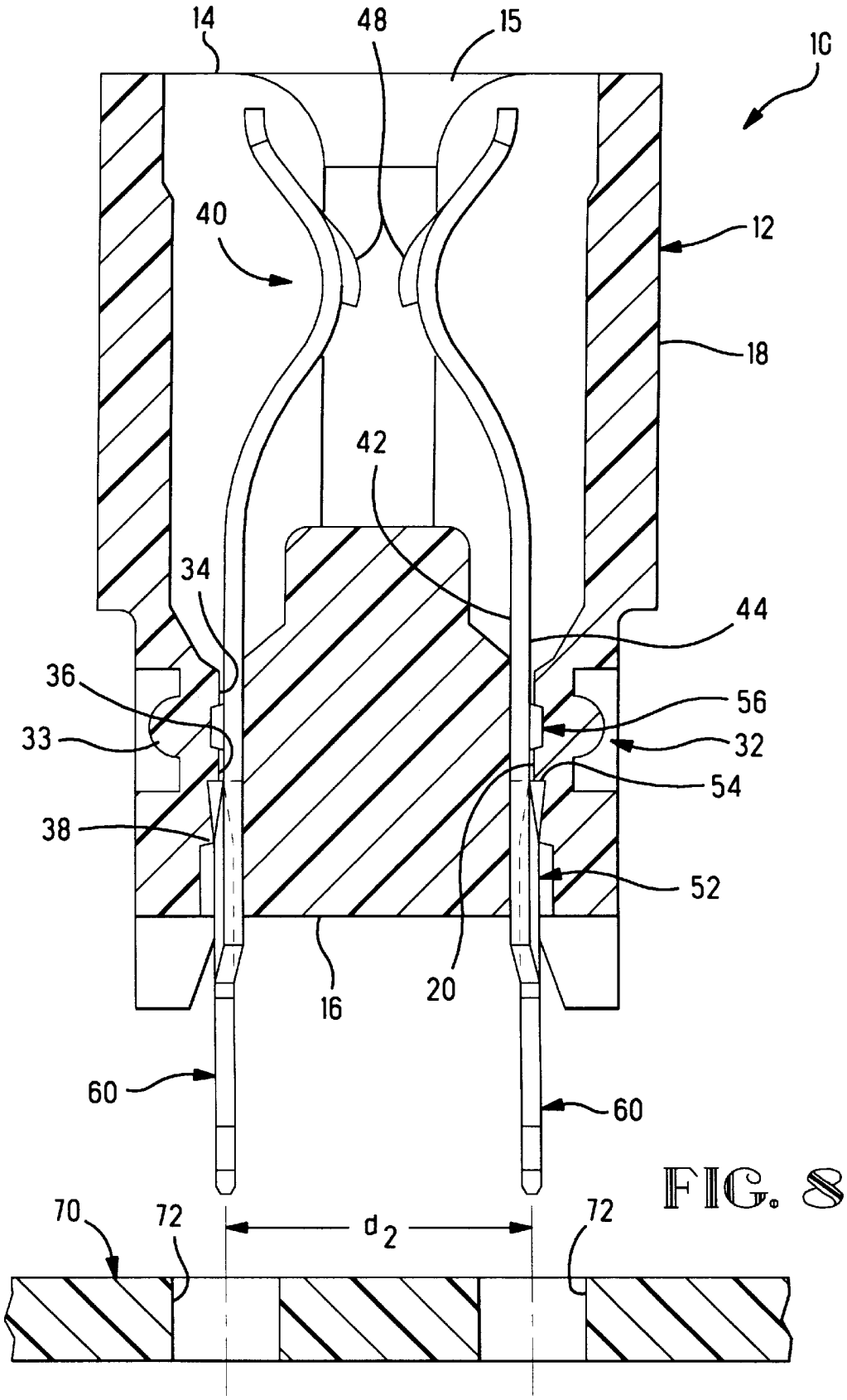
FIG. 8 is a view similar to FIG. 7 after the terminals have been staked in the housing.

Referring now to FIGS. 1 through 8, connector 10 includes a housing 12 having a plurality of terminal receiving passageways 30 and a plurality of terminals 40 disposed therein. Housing 12 includes a mating face 14, an opposed mounting face 16, sidewalls 18 and endwalls 22. Housing 12 further includes an inner wall 24, as best seen in FIGS. 7 and 8. The plurality of terminal receiving passageways 30 extend between the mating and mounting faces 14, 16, respectively and are defined proximate the mounting face 16 by inner surface 20 of outer wall 18 and the surface 26 of inner wall 24. As can be seen in FIG. 7, the walls 20 and 26 in the lower passageway portion are devoid of retention features for the terminal 40. Each passageway 30 has preselected dimension from the outer housing wall 20 to the inner housing wall 26.

Each terminal 40 includes a first major surface and an opposed second major surface 44. Terminal 40 has a thickness dimension that is associated with but less than the dimension of passageway 30 of connector housing 12, as best seen in FIG. 7. Terminal 40 includes a body 50 having a mating section 48 at one end thereof and a board mounting section 60 at the opposite end thereof. Each terminal 40 further includes at least a first embossment 52 extending outwardly from major surface 44. The first embossment 52 includes the board mounting section 60 and at least a portion 51 of the body section 50 adjacent to the board mounting section 60. The first embossment 52 further includes an outwardly directed protrusion 53 formed by shearing the uppermost end thereof. Protrusion 53 forms a push shoulder 54 as best seen in FIGS. 5 and 6. The first embossment 52 extends laterally from the plane of the body section a selected distance $d_1$ to assure that the board mounting section 60 will be accurately positioned with relationship to the circuit board holes upon securing the terminal 40 in housing passageway 30, as best seen in FIGS. 5 and 6. For example, when using a terminal having a thickness of $12.5\times10^{-3}$ inches in a passageway dimensioned to accommodate terminals having a thickness of $25\times10^{31\ 3}$ inches, the board-mounting section would be shifted a lateral distance of about $6.3\times10^{-3}$ inches. In the preferred embodiment, terminal 40 further includes a second embossment 56 spaced above the first embossment 52 on body section 50.

The first embossment, furthermore, strengthens the terminal column to permit the compliant board-mounting sections to be inserted into the terminal-receiving holes. The force required to insert compliant sections can be on the order of 8–15 pounds or greater per terminal. If the column is not sufficiently strong, the terminal will buckle instead of moving into a terminalreceiving hole of the board.

FIGS. 7 and 8 show terminals 40 disposed in respective passageways 30 before and after staking respectfully. As can be seen from these Figures, major surface 42 of terminal 40 lies adjacent the inner surface 26 of inner wall 24 and major surface 44 with the outwardly laterally extending embossments 52, 56 is disposed adjacent surface 20 of the outer housing wall 18. After staking at location 32, as shown in FIG. 8, the housing material is pushed against major surface 44 at locations 34, 36 and 38, with material at 34 being above the second embossment 56, the material at 36 being between the push surface 54 of the first embossment 52 and the second embossment 56 and the material at 38 lying along a portion of the first embossment 52 below the push surface 54.

As can be seen from FIG. 8, the present invention assures that the center line spacing $d_2$ between the respective pairs of board mounting section 60 is the same as the spacing $d_2$ between the associated terminal receiving holes 72 of a circuit board 70. The movement of housing material around the first and second embossments 52 and 56 of the terminals 40 resulting from the staking operation provide sufficient retention force to assure that each terminal 40 is securely held in the housing and has a greater retention force than the resistance encountered when the connector 10 is flat rock inserted to a circuit board 70. The outwardly extending push shoulder 54 provides a surface of housing material 36 that helps to push the compliant board mounting section 60 into the associated terminal receiving or through-hole 72 of board 70. In accordance with the invention, no special tool needs to be used to apply direct force to each individual terminal.

In manufacturing connector 10 in accordance with the present invention, a standard housing 12 is molded from suitable materials, as known in the art. Terminals 40 are stamped and formed in a strip from stock having the desired thickness. To facilitate assembly of the terminals 40 into the housing 12, the housing is placed in a fixture dimensioned to position the board-mounting sections 60 at the selected distance from the mounting face 16 of the housing. The terminals 40 attached to a carrier strip are mass inserted into the respective terminal-receiving passageways 30 in housing 12 with the ends of the board-mounting sections 60 against the fixture and the carrier strip is removed. The connector 10, having the terminals 40 inserted therein, is then passed through a staking station in the assembly line where the terminals 40 are staked in the desired location. The staking operation assures that the major surface 42 is securely held against the inner wall surface 26 and the board-mounting sections 60 are in proper alignment with the circuit board holes 72.

The present invention provides a terminal that is formed of thin stock and is stakable in a housing having terminal-receiving passageways that are dimensioned larger than the thickness of the stock from which the terminal is formed. The present invention further assures that the corresponding board-mounting sections are accurately positioned for mounting to a circuit board.

It is thought that the board mountable electrical connector of the present invention and many of its attendant advantages will be understood from the foregoing description. It is apparent that various changes may be made in the form, construction, and arrangement of parts thereof without departing from the spirit or scope of the invention or sacrificing all of its material advantages.

We claim:

1. A connector of the type having an insulative housing including a plurality of passageways extending therethrough from a mating face to a board-mounting face and positioned to be aligned with terminal-receiving holes of a circuit board, with each passageway having a preselected dimension from an outer housing wall to an inner housing wall, and a plurality of terminals extending from mating sections at the mating face through respective passageways to board-mounting sections extending beyond the board-mounting face, with terminal body sections disposed in and along the passageways to be secured in the housing by staking of the outer housing wall against the terminal body sections adjacent the inner housing wall, characterized in that:

said terminals each having a thickness dimension associated with and less than the preselected passageway dimension, each said terminal including the boardmounting section thereof and at least a portion of the body section thereof adjacent thereto being embossed laterally from the plane of the body section a selected distance, a remaining portion of the body section being disposed adjacent the inner housing wall, said outer housing wall having a portion staked into engagement with said embossed body portion of said terminal therby pressing said body section against said inner wall;

whereby the terminals formed of thin stock are usable with the housing and stakable thereto, while the board-mount sections thereof remain accurately positioned with the terminal receiving holes.

2. The connector of claim 1 wherein a portion of an innermost end of said embossed body portion is sheared from said body section to form an outwardly extending portion defining a rearwardly facing push surface, which cooperates with said housing after the terminal has been staked in the housing, thereby permitting said connector to be mounted to a circuit board by applying force to the top of the connector housing, which in turn applies force to the respective push surfaces to urge the associated board-mounting section of each said terminal into a respective terminal-receiving hole.

3. The connector of claim 1 wherein said board-mounting section of each said terminal includes a compliant portion, said embossed body portion providing sufficient column strength to each said terminal to permit said connector to be mounted to said board by applying force to the top of said housing.

* * * * *

UNITED STATES PATENT AND TRADEMARK OFFICE

CERTIFICATE OF CORRECTION

PATENT NO. : 5,836,792

DATED : November 17, 1998

INVENTOR(S) : Mark Richard Thumma et al.

It is certified that error appears in the above-identified patent and that said Letters Patent is hereby corrected as shown below:

On the title page;

Correct spelling of inventor name:

[75] Charles Dudley Copper

Signed and Sealed this

Ninth Day of March, 1999

*Attest:*

Q. TODD DICKINSON

*Attesting Officer*

*Acting Commissioner of Patents and Trademarks*